United States Patent [19]

Shearer

[11] 4,039,171

[45] Aug. 2, 1977

[54] DRUM DRYER/MIXER

[75] Inventor: Herbert Neil Shearer, Renton, Wash.

[73] Assignee: Boeing Construction Equipment Company, Tukwila, Wash.

[21] Appl. No.: 699,425

[22] Filed: June 24, 1976

[51] Int. Cl.[2] ..... B28C 5/46; G01B 5/04

[52] U.S. Cl. ..... 259/158; 34/136

[58] Field of Search ..... 259/155, 156, 157, 158, 259/159 R; 432/103, 105, 118, 249; 34/135, 136

[56] References Cited

U.S. PATENT DOCUMENTS

| | | | |
|---|---|---|---|
| 1,240,481 | 9/1917 | Popkess | 259/158 |
| 2,904,896 | 9/1959 | Forrest | 34/136 X |
| 3,347,533 | 10/1967 | Mauldin | 259/156 |
| 3,780,447 | 12/1973 | Fales | 34/136 |
| 3,940,120 | 2/1976 | Miller | 259/158 |

*Primary Examiner*—Edward J. McCarthy

*Attorney, Agent, or Firm*—J. Peter Mohn; Kenneth W. Thomas

[57] ABSTRACT

An improved rotating drum dryer and/or mixer for drying or mixing materials on a continuous basis is disclosed. The dryer and/or mixer includes a rotatable drum having an inlet end for receiving materials and a forced air burner for directing a stream of heated gases axially through the drum. A heat dispersing means such as an array of spaced deflecting bars is disposed downstream from the source of heated gases. The dispersing means provides the interior of the drum with a more uniform radial temperature distribution and minimizes the central high temperature zone normally associated with such drum dryers and/or mixers. Minimization of the central high temperature zone results in lowered production of smoke and other noxious emissions by an operating dryer or mixer.

7 Claims, 9 Drawing Figures

DRUM DRYER/MIXER

BACKGROUND OF THE INVENTION

This invention relates to drum dryers and/or mixers and more particularly to such drum dryers and/or mixers of the type used for the continuous drying and/or mixing of materials such as those used in the road paving arts.

In recent years in the road and highway construction field, substantial attention has been directed toward the use of rotating drum mixers for the production of paving compositions on a continuous basis. Typically, such mixers comprise a rotating drums having internal flights for lifting and tumbling materials within the drum and a source of high volume heated gases aligned with the drum for providing the interior of same with a continuous flow of a hot gaseous medium. A typical process for the use of such a drum mixer in the production of an asphalt paving composition is disclosed in my U.S. Pat. No. 3,832,201 issued Aug. 27, 1974 entitled "Process for Making Asphalt Paving Compositions."

The popularity of drum mixers in recent years has been particularly attributable to the increased concerns for the reduction of the emission of pollutants and irritants from pavement-producing equipment. Federal, state and local regulations and statutes typically require that current producers of asphalt paving compositions comply with strict controls on the amounts of particulates, smoke and the like that are emitted from their operating plants. The process disclosed in my U.S. Pat. No. 3,832,201 minimizes the production of particulates from a drum mixer by the addition of liquified asphalt to unconditioned aggregate close to the inlet end of the mixer in order to capture and coat the fines present at that point.

It has been found in the operation of my process that when it is used with certain types of liquified asphalt, substantial amounts of blue smoke are produced at the output stack. The production of such smoke is associated with the use of those asphalts having relatively low smoking points and is caused by the tumbling of the asphalt through, and consequently subjecting the asphalt to, an extreme high temperature one typically found along the central axis of an operating drum mixer. The extreme high temperature zone at the central axis is normally present only near the inlet end of the mixer and eventually dissipates at increasing distances into the mixer from the inlet end. Accordingly, when using low smoking point asphalts, the introduction of the asphalt must oftentimes be made at substantial distances downstream from the inlet end of the mixer. Typically, such distances may be on the order of one-third or more of the overall length of the mixer. When the asphalt is added at such downstream positions, certain of the advantages disclosed in my referenced patent are minimized and in fact particulate emission is increased. The latter result follows from the fact that maximum particulate emission suppression is achieved by introducing the asphalt into the mixer as close as possible to the inlet end thereof.

The conservation of paving material has also been of great interest to the paving industry in recent years. With increased costs of aggregates and asphalts, coupled with lessening supplies of both materials, a need exists for new methods and equipment designed to use less of such materials. One suggested solution to the material cost and supply problem is the use of old materials removed from existing roadways as an ingredient to a paving mixture being prepared for a repaving of such existing or other roadway surfaces. The old removed materials are crushed and reduced in size to workable dimensions. Heretofore, the repaving of such an existing roadway involved the removal of the existing roadway paved surface and the replacing of same with a new paved surface produced from new aggregate and asphalt materials. Typically, the older pavement which is removed is discarded as waste material. It has been proposed to recycle such discarded waste material into new paving material, thereby effecting substantial cost savings as well as conservation goals.

Unfortunately, when recycled paving materials are introduced into present pavement mixing plants, the production of excessive amounts of pollutants has ordinarily resulted. In particular, the introduction of recycled pavement, in lieu of aggregate, into a drum mixing process such as that disclosed in my reference patent, results in the production of excessive amounts of smoke and other irritants. Such pollutant production is once again attributable to the presence of an extreme high temperature zone along the central axis of an operating drum mixer. In the case of the smoking problem attributable to the use of low smoking point asphalts, the introduction of the asphalt substantially downstream in the drum mixer can alleviate the problem. In the case of recycled pavement, however, the old asphalt material is necessarily present immediately at the inlet end of the mixer since it is bonded to the aggregate and cannot economically be removed therefrom.

It is apparent therefore that it is desirable to minimize the extreme high temperature zone present near the central axis of a drum mixer. More particularly, it is desirable to modify the radial temperature distribution present in a drum mixer by minimizing the extreme high temeperature zone present near the central axis of such mixer.

In addition to the drum mixer problems noted above, similar problems caused by the extreme high temperature zone along the central axis of a drum are also present when such drums are used solely for drying purposes. Drum dryers have utility in various industries and prior to the development of drum mixers were used in the asphalt industry to dry aggregate materials prior to their introduction into a pug mill type mixer. Many such drum dryer and pug mill mixer combinations exist throughout the world today and each could have similar problems from smoking, etc., if used with recycled materials as discussed above.

An object of this invention, therefore, is to provide an improved drum dryer and/or mixer.

Another object of this invention is to provide an improved drum dryer and/or mixer having lower noxious emissions than those of the prior art.

A more particular object of this invention is to provide an improved drum dryer and/or mixer having a reduced high temperature zone along its central axis and consequently a more uniform radial temperature distribution within its interior.

SUMMARY OF THE INVENTION

The above and other objects of this invention are achieved in accordance therewith by providing a dryer and/or mixer with a rotating drum having an inlet end for receiving material to be dried and/or mixed and a discharge end. Means for producing and directing a stream of heated gases into the interior of said rotatable drum is also provided. The stream of heated gases is typically flowing in a direction parallel to the flow of materials in the mixer. A dispersing means is disposed downstream from said means for producing and directing a stream of heated gases for dispersing said stream of heated gases across the interior cross-section of said drum in a substantially uniform manner. Lifting flight means are provided along the inner wall of the drum for lifting and tumbling the materials to be dried and/or mixed through the stream of heated gases downstream from the dispersing means. The lifting flight means begin substantially at the position of the dispersing means and extend downward towards the discharge end of the drum. Means for introducing materials to be dried and/or mixed are provided near the inlet end of the drum. In addition, in the case of the operation of the apparatus as a mixer for producing asphalt pavement, means are also provided for the introduction of a bituminous binder onto the aggregate within the drum. By dispersing the stream of heated gases, the existence of an extreme high temperature zone near the central axis of the drum is minimized and materials tumbled through the drum are not subjected to the intense high temperatures which otherwise might cause them to emit smoke and other noxious emissions.

BRIEF DESCRIPTION OF THE DRAWINGS

The above and other objects and features of this invention will be better understood from the following detailed description and appended claims taken in conjunction with the attached drawings wherein:

DETAILED DESCRIPTION OF A PREFERRED EMBODIMENT

Figure 1:
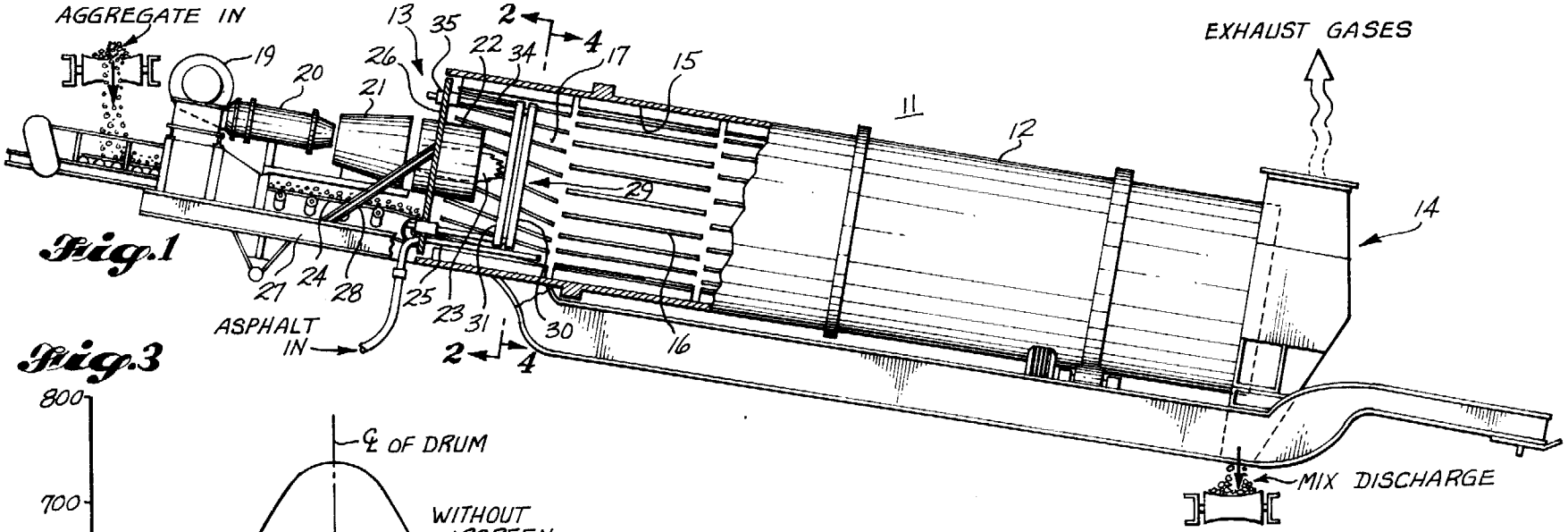
FIG. 1 is an overall pictorial diagram, in cutaway form, of one embodiment of an asphalt mixer constructed in accordance with this invention.

Referring now to the drawings, it should be first noted that throughout all the figures, the same reference numerals have been used to indicate the same elements or parts. Referring particularly to FIG. 1, an improved drum mixer designated generally as 11, and constructed in accordance with one embodiment of this invention is shown. Drum mixer 11 comprises a cylindrical drum 12 having an inlet end 13 and a discharge end 14. Drum 12 is provided along its inner wall 15 with a plurality of lifting flights such as 16. Lifting flights 16 serve to lift and tumble the materials being mixed in the drum across the inner section of the drum. The drum also be provided with a plurality of spirally disposed fast flights such as 17. The fast flights do not tumble the material across the drum but instead serve to auger materials to be mixed rapidly into the mixing zone of the drum.

A source of heated gases is provided adjacent one end of the drum 12 and in FIG. 1 is shown adjacent to the inlet end 13 of drum 12. The source of heated gases comprises a forced air blower 19, a burner 20, pre-ignition port 21 and combustion chamber 22. Burner 20 is typically of the oil burning variety and in combination with the other noted components produces a stream of very-high temperature gases which are typically directed into the drum 12, generally along its central axis. In operation, an open flame 23 typically exists within the drum as shown. When mixer 11 is operated to produce a bituminous paving composition, aggregate is introduced into the drum 12 near its inlet end 13 by means such as conveyor belt 24. Additionally, a bituminous binder, such as preheated asphalt cement, is discharged onto the aggregate within the drum from asphalt feed pipe 25. During its operation, drum 12 is rotated by suitable mechanical structure, not shown or described.

The inlet end 13 of the mixer 11 is ordinarily substantially closed by a firewall 26. Firewall 26 is attached to the rigid mounting frame 27 of the drum mixer and may be reinforced by support brackets 28.

Heat dispersing screen, or grid, 29 is mounted within the drum, downstream from the tip of the flame 23 and upstream from the beginning of lifting flights 16. Screen 29 in the embodiment of FIG. 1 comprises a first array 30 and a second array 31, each including a plurality of heat-resistant members such as 32 and 33, respectively, of FIG. 2. Arrays 30 and 31 are supported from firewall 26 by a plurality of mounting bars such as 34. To permit axial adjustment of the position of the dispersion screen 29, mounting bars 34 may be adjustably fixed to firewall 26 by means of sleeves such as 35. Means such as a lock screw, not shown, are provided on mounting sleeves 35 to rigidly position bar 34.

Figure 2:
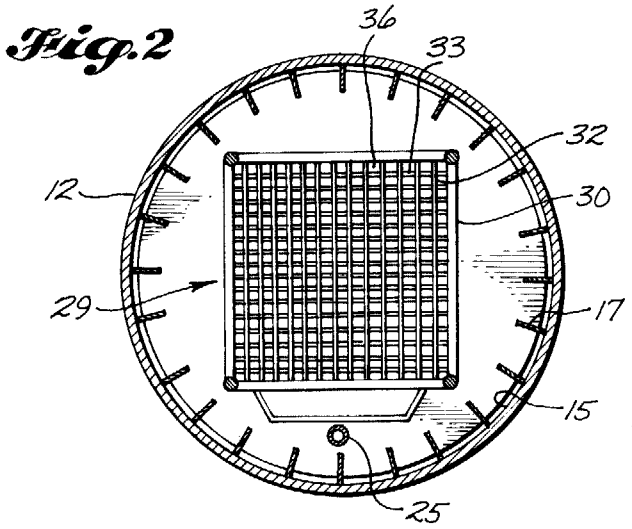
FIG. 2 is a sectional view of the mixer of FIG. 1 taken along line 2—2 thereof, and showing one embodiment of a dispersion screen constructed in accordance with this invention.

Referring now to FIG. 2, further details of the dispersion screen 29 may be noted. A first array of heat-resistant members comprises a plurality of spaced vertically-disposed members such as 32, all arranged in substantially parallel relationship to each other and within a rigid frame 30. Similarly, a second array comprises a plurality of spaced heat-resistant members 33 horizontally disposed and substantially parallel to each other within a rigid frame 31. The first array is aligned within the mixer so as to be substantially within a plane perpendicular to the central axis of the mixer. Similarly, the second array is disposed in a plane, also perpendicular to the mixer central axis. The respective parallel members of the first and second arrays are disposed in perpendicular relationship to each other so as to form a screen or grid having openings 36 for the passage of heated gases to the downstream regions of mixer 11.

It has been found that screen 29 functions to disperse the stream of hot gases coming from the forced air burner and in fact causes a more uniform radial distribution of temperatures within the drum. More importantly, the screen 29 substantially minimizes the normal extreme high temperature zone that is usually present along the central axis of a drum mixer, particularly near its burner end. The materials from which the screen 29 is fabricated necessarily must be capable of withstanding extremely high temperatures. It has been found that numerous such materials are available and in one embodiment of the invention actually constructed, the heat-resistant members 32 and 33 were bars of a material sold by the Carborundum Corporation under the trade name CARBOFRAX type A. Various heat-resistant metals and materials such as ceramics and steel alloys could of course be used to construct the components of screen 29, depending on the particular operating parameters of the mixer in which it is used.

Figure 3:
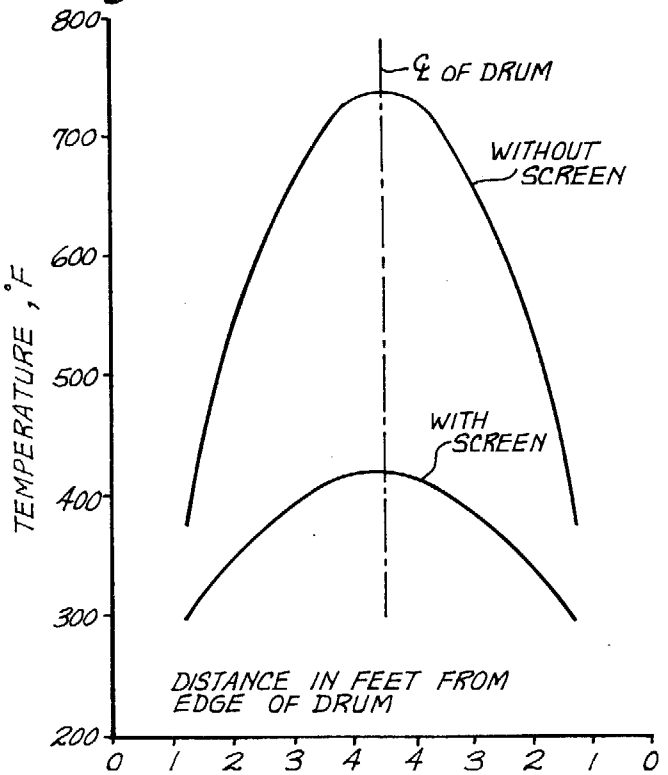
FIG. 3 is a graph showing the effect of one embodiment of this invention on the temperature distribution within a drum dryer.

Referring now to FIG. 3, the actual results obtained by installation of a screen are shown in graphical form. FIG. 3 is a plot of the various temperature measurements as a function of distance in feet from the center of a drum radially outward towards its outer wall. The temperature measurements summarized in FIG. 3 were taken from a drum mixer substantially as shown in FIG. 1, however asphalt was not being added and instead the mixer was in essence being operated as an aggregate dryer. The measurements noted were taken at points approximately 9½ feet into the drum from the inlet end. In particular, the construction and specification of the test mixer was as follows:

| | |
|---|---|
| Drum Length | 38 feet |
| Drum Diameter | 9 feet |
| Burner | 162,000,000 btu |
| Airflow | approx. 20,000 cfm |
| Production rate | 200 tons per hour |
| Discharge temperature | 240 degrees F. – 258 degrees F. |
| Screen | 2 ft. × 5 ft. sq. stainless steel frame; circular cross-section CARBOFRAX bars spaced to provide 2 in. by 2 in. openings between bars. |

It should be noted that the above dimensions and specifications are given by way of example only and various sizes, materials and screen arrays could be used without departing from the spirit and scope of this invention.

It may be observed from FIG. 3 that operation of the drum with the screen in place results in a substantially reduced temperature along the central axis of the drum. In fact, the center temperature has been reduced from one in excess of 700° F. to one slightly in excess of 400° F. It should be apparent, therefore, that the material being tumbled through the central zone of the mixer will be subjected to substantially less high temperature and the smoking of substances in the material may be eliminated.

Figure 4:
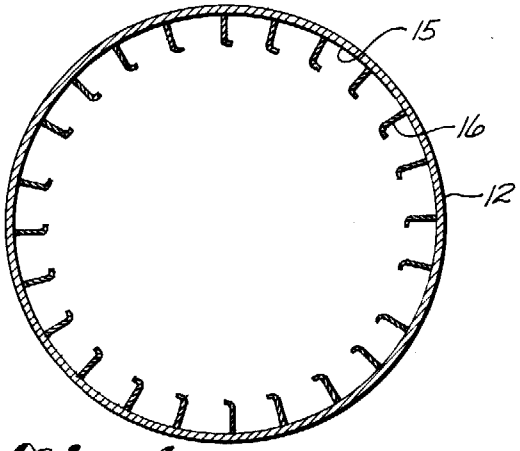
FIG. 4 is a sectional view in somewhat schematic form of the drum mixer of FIG. 2 taken along line 4—4 thereof, showing the lifting flights provided on the inner wall thereof.

FIG. 4 is a sectional view of the drum 12 taken along line 4—4 of FIG. 1, showing a typical array of lifting and tumbling buckets, such as 16, attached to the inner wall 15 of drum 12. The particular form and configuration of bucket 16 does not form a part of this invention and it should be understood that any suitable lifting and tumbling flight structure may be used when constructing a drum dryer or mixer in accordance with this invention.

Figure 5:
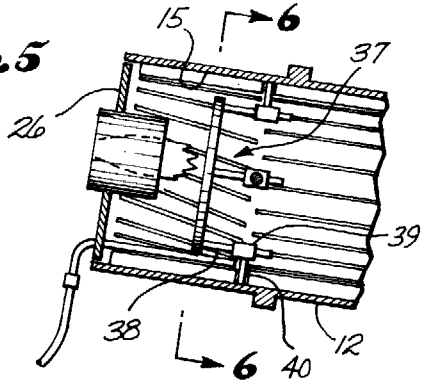
FIG. 5 is a partial cutaway view of the inlet end of a drum dryer/mixer such as that of FIG. 2 showing another embodiment of the dispersion screen of this invention.

FIG. 5 shows a somewhat different mounting arrangement for a heat dispersing screen 37. In the embodiment of FIG. 5, the dispersing screen 37 is adjustably affixed to the drum wall 15 as opposed to being supported from the firewall 26 as in the embodiment of FIG. 1. In the FIG. 5 embodiment, the screen 37 is supported by a plurality of mounting bars such as 38 which are slidably engaged in mounting sleeves such as 39. Sleeves 39 are, in turn, rigidly affixed to drum wall 15 by spacers such as 40 by welding or the like. Each mounting sleeve 39 is provided with a fastening means such as a locking screw, not shown, to rigidly affix screen 37 in its desired position. It should be apparent from the embodiment of FIG. 5 that screen 37 is axially adjustable as in the embodiment of FIG. 1. Screen 37 differs somewhat in its operation from screen 29 in that it rotates with the drum as opposed to being stationary with respect to the drum. In addition to a somewhat different mounting arrangement, screen 37 of the embodiment of FIG. 5 is shown as having a circular shape as opposed to the square shape of FIG. 1. This latter feature is best shown in FIG. 6 which is a sectional view taken along line 6—6 of FIG. 5.

Figure 6:
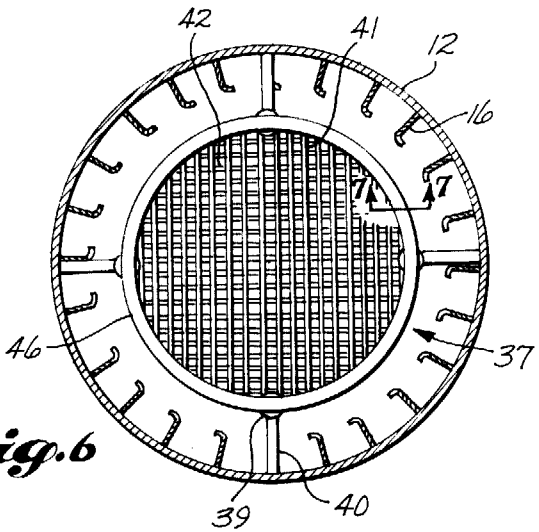
FIG. 6 is sectional view of the embodiment of FIG. 5 taken along line 6—6 thereof.

As will be readily observed from FIG. 6, the circular screen 37 permits the construction of a dispersion surface having substantially larger area than the square embodiment of FIG. 1. As may also be noted from FIG. 6, however, the array of heat-deflecting members such as vertical member 41 and horizontal member 42 is substantially similar to the embodiment of FIG. 1. Namely, a plurality of vertical members 41 are arranged and spaced in parallel relationship to each other in a first plane and a plurality of members are arranged in spaced parallel relationship to each other in a second plane, the members 41 being substantially perpendicular to the members 42. The composite screen or grid shown in either FIGS. 1 and 2 or 5 and 6 operates to permit a portion of the stream of heated gases to pass through the openings in the grid and at the same time cause the remainder of the stream of heated gases to be dispersed outwardly towards the drum wall.

Figure 7B:
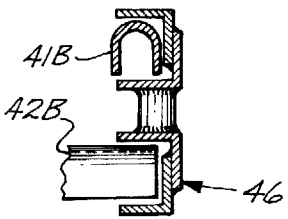
FIGS. 7A and 7B are sectional views taken along line 7—7 of FIG. 6 showing details of construction of two embodiments of the screen of FIG. 5.
Figure 7A:
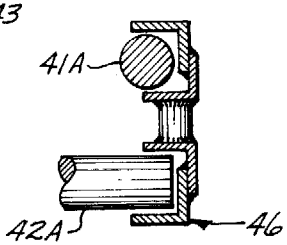

The particular cross-sectional shape of the heat-deflecting members such as 32 and 33 of FIG. 2 or 41 and 42 of FIG. 6 may vary in accordance with this invention. Referring to FIGS. 7A and 7B, which are cross-sectional views taken along line 7—7 of FIG. 6, two different embodiments of the heat-deflecting members or bars are shown. More particularly, in FIG. 7A the deflecting members such as 41A and 42A are shown as having a solid circular cross-section. In FIG. 7B, the members such as 41B and 42B are shown as having a substantially U-shaped cross-section with the open side of the U being arranged to face towards the downstream direction within the drum. The U-shaped members may be fabricated from heat-resistant material such a Inconel Alloy 625 as marketed by the International Nickel Company. In the embodiment of FIG. 7B, it has been found that the use of a U-shaped cross-sectional member as shown may promote radiation of heat from the screen and assist in providing a more uniform temperature distribution downstream in the drum.

Figure 8:
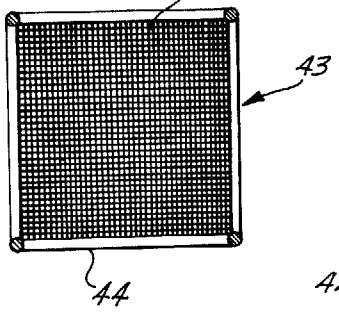
FIG. 8 shows another embodiment of a dispersion screen constructed in accordance with this invention.

In FIG. 8, still another embodiment of a dispersion screen 43 is shown. Screen 43 comprises an outer frame 44 within which is a fixed, a suitably shaped piece of heat-resistant wire mesh 45. Such heat-resistant wire mesh 45 is readily available from suppliers, and the details of same do not form a part of this invention.

Although various configurations of dispersion screens have been shown and described herein, it should be understood that numerous other screen arrangements could be constructed without departing from the scope of this invention. For example, additional arrays of parallel deflecting bars could be provided at 45° angles to the bars shown. Furthermore, in certain applications it may be desirable to provide only a single array of parallel bars without providing a second array perpendicular to the first so as to form a gridwork. Additionally, a dispersion screen in accordance with this invention could be constructed from a plurality of concentric rings of heat-deflecting members attached to each other in spaced relationship by a plurality of radially extending deflecting members in a configuration such as the spokes of a wheel.

From the above detailed description and drawings, it should be apparent that the use of a rotating drum dryer or mixer having a heat-dispersion means such as those described permits the drying and/or mixing of materials on an efficient basis and yet without extreme production of excessive smoke or other irritants. The latter desired result is achieved by the elimination of the extrene high temperature zone ordinarily existing along the central axis of a drum dryer or mixer so that materials to be dried or mixed may be tumbled through the central zone of such a dryer or mixer without being exposed to high temperatures in excess of the particular smoking points of those materials. In the case of good operation of this invention as an asphalt pavement drum mixer, the production of useful paving material from recycled aggregate has been achieved without the emission of substantial amounts of smoke and other irritants as were previously experienced with the mixers of the prior art. Similarly, the use of an improved mixer such as described herein for the practicing of my previously patented process, noted above, permits asphalt cements having fairly low smoking points to be nevertheless added near the inlet end of a mixer, thereby achieving maximum reduction in the emission of particulates and fines from the output stack.

Although this invention has been described with respect to particular embodiments thereof, it should be understood that various other embodiments could be constructed without departing from the spirit and scope of my invention as defined in the following claims.

I claim:

1. A mixer for the preparation of a bituminous paving composition or the like comprising:

a rotatable drum having an inlet end for the reception of aggregate and a discharge end;

burner means and cooperating blower means for producing and directing radiant energy and a stream of heated gases into the interior of said drum;

said burner means producing an open flame and being substantially aligned with the central axis of said drum and positioned to direct the radiant energy of its open flame into the interior of said drum; heat dispersing means disposed within said drum downstream from said burner means and extending across a portion of the interior cross-section of said drum;

means for introducing aggregate into said drum at substantially the inlet end thereof;

means for discharging a bituminous binder onto the aggregate within said drum;

lifting flight means disposed along the inner wall of said drum for lifting and tumbling said aggregate and said binder through said stream of heated gases within the volume of said drum downstream from said dispersing means;

said lifting flight means beginning substantially at the position of said dispersing means and extending toward the discharge end of said drum.

2. The mixer of claim 1 wherein said dispersing means comprises a plurality of bars of heat-resistant material aligned in a plane disposed substantially perpendicular to the central axis of said dryer.

3. The mixer of claim 1 wherein said dispersing means comprises an array of heat-resistant members arranged in spaced relationship to each other and extending across a portion of the interior cross-sectional area of said drum.

4. The mixer of claim 1 wherein said dispersing means comprises a first plurality of heat deflecting members in spaced parallel relationship with each other disposed in a first plane substantially perpendicular to the central axis of said drum and a second plurality of heat deflecting members in spaced parallel relationship to each other disposed in a second plane substantially parallel to said first plane, said members disposed in said first plane being substantially perpendicular to said members disposed in said second plane.

5. The mixer of claim 4 wherein all said heat deflecting members are comprised of heat-resistant bars of substantially circular cross-section.

6. The mixer of claim 4 wherein all said heat-deflecting members are comprised of heat-resistant material having a substantially U-shaped cross-section, the open portions of said U-shaped members being aligned to face substantially downstream in said drum.

7. The mixer of claim 1 wherein said dispersing means comprises a mesh of heat-resistant material disposed in a plane substantially perpendicular to the central axis of said drum.

* * * * *